US011230790B2

(12) United States Patent
Tsuchida et al.

(10) Patent No.: US 11,230,790 B2
(45) Date of Patent: Jan. 25, 2022

(54) PLATING PROCESSING APPARATUS

(71) Applicant: SUMITOMO ELECTRIC TOYAMA CO., LTD., Imizu (JP)

(72) Inventors: Hitoshi Tsuchida, Imizu (JP); Ryuichi Yoshikawa, Imizu (JP)

(73) Assignee: SUMITOMO ELECTRIC TOYAMA CO., LTD., Imizu (JP)

( * ) Notice: Subject to any disclaimer, the term of this patent is extended or adjusted under 35 U.S.C. 154(b) by 141 days.

(21) Appl. No.: 16/614,046

(22) PCT Filed: Jan. 23, 2019

(86) PCT No.: PCT/JP2019/001948
§ 371 (c)(1),
(2) Date: Nov. 15, 2019

(87) PCT Pub. No.: WO2019/181179
PCT Pub. Date: Sep. 26, 2019

(65) Prior Publication Data

US 2021/0087703 A1 Mar. 25, 2021

(30) Foreign Application Priority Data

Mar. 22, 2018 (JP) ..... JP2018-054649

(51) Int. Cl.
*C25D 17/00* (2006.01)
*C25D 21/12* (2006.01)

(52) U.S. Cl.
CPC ..... *C25D 17/007* (2013.01); *C25D 21/12* (2013.01)

(58) Field of Classification Search
CPC ..... C25D 17/007; H01B 5/02
See application file for complete search history.

(56) References Cited

FOREIGN PATENT DOCUMENTS

| | | |
|---|---|---|
| JP | S 62-112798 A | 5/1987 |
| JP | H 11-269698 A | 10/1999 |
| JP | 2002-75058 A | 3/2002 |

*Primary Examiner* — Ho-Sung Chung
(74) *Attorney, Agent, or Firm* — Faegre Drinker Biddle & Reath LLP

(57) ABSTRACT

A plating processing apparatus in which a plating object is immersed in a plating solution to form a plating layer on a surface of the plating object. A plating tank contains the plating solution, and a power supply roller is rotated while supplying electric power to the plating object, and conveys the plating object to be immersed into the plating solution contained in the plating tank and then moved to the outside of the plating solution. An anode case is disposed inside the plating tank and held in electrical contact with the plating solution contained in the plating tank, and a control panel controls electric power supplied to the power supply roller and the anode case. A first busbar electrically connects the power supply roller and the control panel, and a second busbar electrically connects the anode case and the control panel.

9 Claims, 5 Drawing Sheets

PLATING PROCESSING APPARATUS

TECHNICAL FIELD

The present disclosure relates to a plating processing apparatus.

This application claims priority based on Japanese Patent Application No. 2018-054649 filed on Mar. 22, 2018, the entire contents of which are incorporated herein by reference.

BACKGROUND ART

Japanese Unexamined Patent Application Publication No. 2002-075058 (Patent Literature (PTL) 1) discloses a copper-made busbar having high corrosion resistance, which is constituted by a base member made of copper or a copper alloy and a coating layer made of titanium or a titanium alloy sheet and covering a surface of the base member, and in which a contact interface between the base member and the sheet and a contact interface between end edges of the sheet are subjected to diffusion bonding.

CITATION LIST

Patent Literature

PTL 1: Japanese Unexamined Patent Application Publication No. 2002-075058

SUMMARY OF INVENTION

According to one aspect of the present disclosure, there is provided a plating processing apparatus in which a plating object is immersed in a plating solution to form a plating layer on a surface of the plating object, the plating processing apparatus comprising:

a plating tank containing the plating solution;

a power supply roller rotated, while supplying electric power to the plating object, to convey the plating object to be immersed into the plating solution contained in the plating tank and then moved to outside of the plating solution;

an anode case disposed inside the plating tank and held in electrical contact with the plating solution contained in the plating tank;

a control panel controlling electric power supplied to the power supply roller and the anode case;

a first busbar electrically connecting the power supply roller and the control panel; and a second busbar electrically connecting the anode case and the control panel, wherein the first busbar and the second busbar are each constituted by a plurality of busbar members each of which includes a copper-made base member and a titanium-made coating layer covering a surface of the base member, the first busbar and the second busbar include a first connection portion in which the busbar members are connected to each other and a second connection portion in which the busbar member is connected to the power supply roller, the anode case, or the control panel, and a portion of the busbar member other than the first connection portion and the second connection portion includes a gap between the base member and the coating layer.

DESCRIPTION OF EMBODIMENTS

Figure 1:
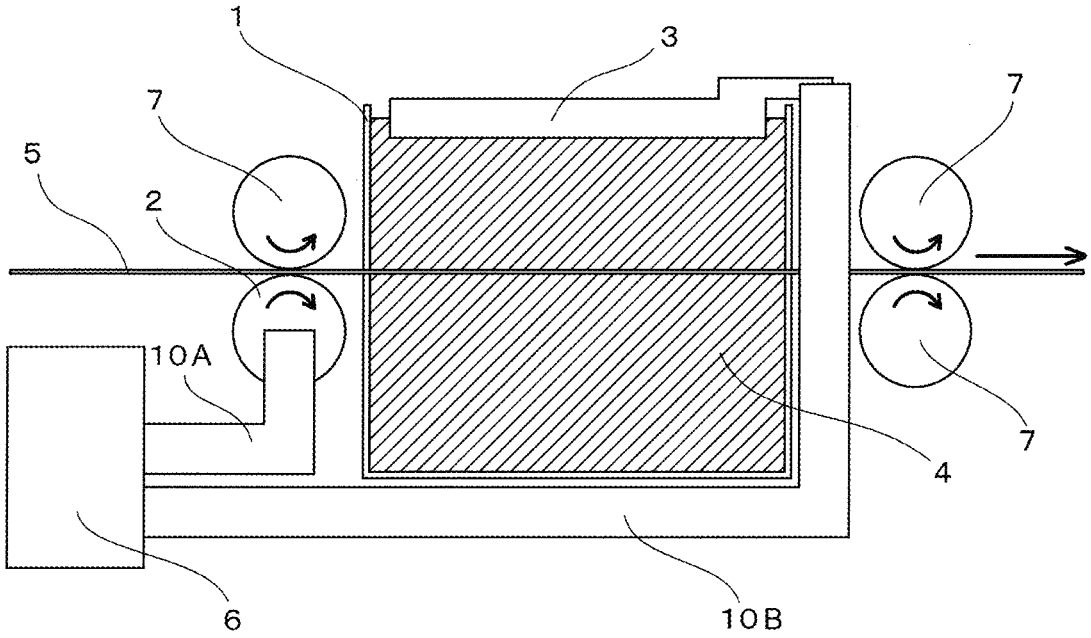
FIG. 1 schematically illustrates one example of a plating processing apparatus according to an embodiment of the present disclosure.

Problems to be Solved by Present Disclosure

In a plating processing apparatus capable of continuously carrying out a plating process on a plating object in the form of a long sheet, the plating process is generally carried out by supplying electric power to both a power supply roller, which supplies electric power to the plating object while conveying the plating object, and an anode case disposed in a plating tank. The power supply roller and the anode case are each connected to a control panel, and a current density, etc. are adjusted by the control panel.

To efficiently carry out the plating process on the plating object of a large size, a large current needs to be supplied to each of the power supply roller and the anode case. For that reason, a busbar made of copper (e.g., C1100) having high electrical conductivity is used, instead of a cable or a wire, for connection between the power supply roller and the control panel and connection between the anode case and the control panel.

However, because corrosion resistance of copper against acidic acids is low, countermeasures such as, for example, coating a resin lining over the copper-made busbar in its portion near the plating tank and keeping the copper from being brought into contact with a plating solution need to be taken. The busbar coated with the resin lining causes no problems during a period in which a lining layer is stably maintained in a sound state, but peeling-off of resin tends to occur due to heat generated by the busbar during power-on time. If the resin lining peels off from the busbar, there is a possibility that corrosion of the copper may progress from a peeled-off portion.

Another known method of protecting the copper-made busbar from the plating solution is to weld titanium having high corrosion resistance to a copper surface.

In the copper-made busbar disclosed in the above-cited PTL 1, copper is protected by being covered with titanium having high corrosion resistance. To manufacture the copper-made busbar disclosed in PTL 1, copper and titanium need to be subjected to diffusion bonding by heating them to temperature of 700° C. to 850° C. under a reducing or vacuum atmosphere. Therefore, a step of, for example, removing a copper oxide film and contaminants in advance is required, and a manufacturing method is complicated. Furthermore, processing copper at such a high temperature may lead to a possibility of reducing copper strength. Moreover, to manufacture a busbar having a large size (e.g., a busbar having a length of several meters to several ten meters), it is required in a manufacturing process to use a large-scale furnace, or to join a plurality of small-size busbars. Using the large-scale furnace is not realistic, and joining the plurality of small-size busbars not only makes a busbar manufacturing process more complicated, but also increases electrical resistance because of an increase in the number of connection portions given as titanium-to-titanium contact portions.

In the copper-made busbar disclosed in PTL 1, as described above, a contact interface between copper and titanium is entirely integrated by diffusion bonding. In such a case, when the copper is expanded due to heat generated during power-on time, the titanium acts to hold down the expanding copper because the titanium has a smaller coefficient of thermal expansion. Accordingly, when the busbar is used for a long period, there is a possibility that the titanium may be damaged, for example, cracked.

Another method of protecting the copper in the copper-made busbar is to coat a resin lining over the copper surface. However, because the resin is poor in durability over a long period and has high electrical resistance, a connection between the busbars or between the busbar and a member other than the busbar is heated to comparatively high temperature during power-on time.

An object of the present disclosure is to provide a plating processing apparatus including busbars that have high corrosion resistance and that can be used stably for a long period.

Advantageous Effects of Present Disclosure

According to the present disclosure, the plating processing apparatus can be provided which includes busbars having high corrosion resistance and being usable stably for a long period.

Description of Practical Examples of Present Disclosure

First, practical examples of the present disclosure are listed as follows.

(1) A plating processing apparatus according to a practical example of the present disclosure includes a plating object that is immersed in a plating solution to form a plating layer on a surface of the plating object, the plating processing apparatus comprising:

a plating tank containing the plating solution;

a power supply roller rotated while supplying electric power to the plating object, and conveying the plating object to be immersed into the plating solution contained in the plating tank and then moved to outside of the plating solution;

an anode case disposed inside the plating tank and held in electrical contact with the plating solution contained in the plating tank;

a control panel controlling electric power supplied to the power supply roller and the anode case;

a first busbar electrically connecting the power supply roller and the control panel; and a second busbar electrically connecting the anode case and the control panel, wherein the first busbar and the second busbar are each constituted by a plurality of busbar members each of which includes a copper-made base member and a titanium-made coating layer covering a surface of the base member, the first busbar and the second busbar include a first connection portion in which the busbar members are connected to each other and a second connection portion in which the busbar member is connected to the power supply roller, the anode case, or the control panel, and a portion of the busbar member other than the first connection portion and the second connection portion includes a gap between the base member and the coating layer.

With the practical example of the present disclosure defined in above (1), the plating processing apparatus can be obtained which includes the busbars having high corrosion resistance and being usable stably for a long period. The expression "the busbar member is connected to the control panel" implies the case in which the busbar member is directly connected to the control panel, and the case in which the busbar member is indirectly connected to the control panel through a conductive member. In the latter case, if the control panel is not under a corrosive environment, there are no problems even when a conductive member without corrosion resistance is used in the surrounding of the control panel. Connecting the conductive member and the control panel makes it possible to reduce electrical resistance and to supply a larger current.

(2) In the plating processing apparatus defined in above (1), preferably, the gap is not smaller than 1 μm.

With the practical example of the present disclosure in above (2), since the gap of not smaller than 1 μm is present between the copper-made base member and the titanium-made coating layer, stress exerted on the titanium-made coating layer can be suppressed when the copper-made base member is thermally expanded due to heat generated with supply of electric power.

(3) In the plating processing apparatus defined in above (1) or (2), preferably, the base members are directly welded to each other in the first connection portion.

With the practical example of the present disclosure defined in above (3), in the first connection portion in which the busbar members are connected to each other, the electrical resistance can be reduced and hence the heat generated with supply of electric power can be reduced.

(4) In the plating processing apparatus defined in above (1) or (2), preferably, an end portion of one of the base members has a T-like shape in the first connection portion, and the first connection portion includes a plurality of screw holes with a plurality of bolts screwed into the plurality of screw holes for connection.

With the practical example of the present disclosure defined in above (4), the busbar members can easily be connected with sufficient strength, and they can also easily be separated from each other.

(5) In the plating processing apparatus defined in any one of above (1) to (4), preferably, a connection portion of the busbar member or a connection portion of the power supply roller, the anode case, or the control panel, which is connected to the busbar member, has a T-like shape in the second connection portion, and the second connection portion includes a plurality of screw holes with a plurality of bolts screwed into the plurality of screw holes for connection.

With the practical example of the present disclosure defined in above (5), the busbar member can easily be connected to a member (such as the anode case, the power supply roller, the control panel, or the conductive member connected to the control panel) other than the busbar member with sufficient strength, and it can also easily be separated therefrom.

(6) In the plating processing apparatus defined in above (4) or (5), preferably, the number of the bolts is one or more per current of 125 A flowing in the first connection portion or the second connection portion.

With the practical example of the present disclosure defined in above (6), since the electrical resistance can be reduced in the first connection portion or the second connection portion having the T-like shape, heat generation in the first connection portion or the second connection portion having the T-like shape can be reduced.

(7) In the plating processing apparatus defined in any one of above (4) to (6), preferably, the bolts are made of stainless.

With the practical example of the present disclosure defined in above (7), the connection strength can be further increased in the first connection portion or the second connection portion having the T-like shape.

(8) In the plating processing apparatus defined in any one of above (4) to (7), preferably, inner peripheral surfaces of the screw holes which are formed in the busbar member and into which the bolts are screwed are covered with the titanium-made coating layers.

With the practical example of the present disclosure defined in above (8), the corrosion resistance of the busbar member can be further increased in the first connection portion or the second connection portion having the T-like shape.

DETAILS OF EMBODIMENT OF PRESENT DISCLOSURE

Practical examples of a plating processing apparatus according to an embodiment of the present disclosure will be described in more detail below.

It is to be noted that the present invention is not limited to the following examples and is intended to include all modifications falling within the scope defined by Claims and regarded as being equivalent in meaning to the Claims.

FIG. 1 schematically illustrates one example of a plating processing apparatus according to an embodiment of the present disclosure. As illustrated in FIG. 1, the plating processing apparatus according to the embodiment of the present disclosure includes a plating tank 1, a power supply roller 2, an anode case 3, a first busbar 10A, and a second busbar 10B. A plating solution 4 is filled in the plating tank 1, and the anode case 3 is disposed to position at a liquid surface of the plating solution 4. The anode case 3 contains a metal to be plated on a plating object 5. The plating object 5 is in the form of a long sheet and is conveyed in a state sandwiched between a feed roller 7 and the power supply roller 2 or between a pair of feed rollers 7 such that it is moved from the left side to the right side in FIG. 1. Electric power is supplied to the plating object 5 from the power supply roller 2 outside the plating tank 1, and the plating object 5 acts as a cathode inside the plating tank 1. In the plating tank 1, therefore, electrolysis occurs between the plating object 5 and the metal disposed inside the anode case 3. As a result, the metal disposed inside the anode case 3 is dissolved into the plating solution 4 and is precipitated as a plating film on a surface of the plating object 5.

Because the plating object 5 in the form of a long sheet has a large surface to be plated, a large current has to be supplied to the plating object 5 and the anode case 3 in order to continuously perform a plating process with high efficiency. From that point of view, the power supply roller 2 and the anode case 3 are connected to a control panel 6 through the first busbar 10A and the second busbar 10B, respectively, each of which allows the large current to flow therethrough.

For example, a steel plate or a base member used for manufacturing a metallic porous body with a skeleton of three-dimensional mesh-like structure (i.e., a resin compact with a skeleton of three-dimensional mesh-like structure) can be preferably used as the plating object 5 in the form of a long sheet.

In the plating processing apparatus illustrated in FIG. 1, the first busbar 10A and the second busbar 10B are each connected to the control panel 6. However, when the control panel 6 and the plating tank 1 are sufficiently away from each other and the control panel 6 is not under a corrosive environment, the first busbar 10A and the second busbar 10B may be each connected to a conductive member that is connected to the control panel 6. Here, examples of the conductive member include a copper-made busbar made of tough pitch copper (C1100) or oxygen-free copper (C1020), an aluminum-made busbar, and a busbar obtained by plating at least a part of any of those busbars. If the control panel 6 is not under the corrosive environment, there are no problems even when a conductive member without corrosion resistance is used in the surrounding of the control panel 6. In some cases, the electrical resistance can be rather reduced by using the conductive member for connection to the control panel 6. Thus, the first busbar 10A and the second busbar 10B are just required to be used in at least the place under the corrosive environment near the plating tank 1. When the conductive members are connected to the control panel 6, large currents can be supplied to the power supply roller 2 and the anode case 3 by connecting the first busbar 10A and the second busbar 10B to the conductive members.

The composition of the plating solution 4 is not limited to particular one, and it may be selected as appropriate depending on a metal or an alloy to be plated on the plating object 5. Thus, known plating solutions can be optionally used as the plating solution 4. For example, a nickel plating solution is used when nickel is to be plated on the plating object 5, and a copper plating solution is used when copper is to be plated thereon.

The first busbar 10A and the second busbar 10B are each constituted by a plurality of busbar members.

Figure 2:
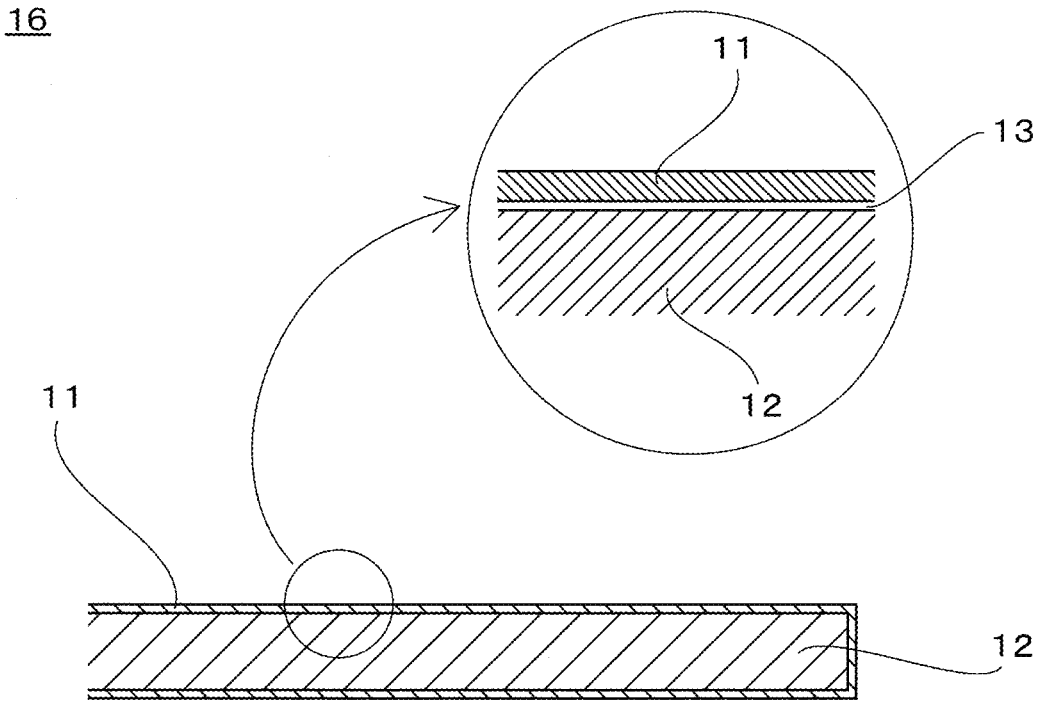
FIG. 2 schematically illustrates an example of a busbar member used in the one example of the plating processing apparatus according to the embodiment of the present disclosure.

FIG. 2 is a partial sectional view of an example of a busbar member 16 used in the plating processing apparatus according to the embodiment of the present disclosure. As illustrated in FIG. 2, the busbar member 16 is formed by covering a surface of a copper-made base member 12 with a titanium-made coating layer 11. Regarding the busbar member 16, in not only a portion (first connection portion) in which the busbar members 16 are connected to each other, but also a portion (second connection portion) in which the busbar member 16 is connected to a member (such as the anode case, the power supply roller, the control panel, or the conductive member connected to the control panel) other than the busbar member 16, the copper-made base member 12 and the titanium-made coating layer 11 are preferably held in close contact with each other from the viewpoint of reducing electrical resistance in the connection portion. In the first connection portion, as described later, the copper-made base members 12 of the busbar members 16 may be connected to each other by direct bonding. In such a case, since electrical conduction is established by the copper-made base members 12, the copper-made base member 12 and the titanium-made coating layer 11 are not always required to be held in close contact with each other in the first connection portion.

Furthermore, in the busbar member 16, a gap 13 is formed between the copper-made base member 12 and the titanium-made coating layer 11 in at least a portion other than the first connection portion or a portion other than the second connection portion. The gap 13 implies a spacing distance between a surface of the copper-made base member 12 and a surface of the titanium-made coating layer 11. With the busbar member 16 having the gap 13 between the copper-made base member 12 and the titanium-made coating layer 11, even when the copper-made base member 12 is expanded due to heat generated during power-on time, excessive stress can be kept from being applied to the coating layer 11 because the gap 13 functions as a buffer region.

The gap 13 between the copper-made base member 12 and the titanium-made coating layer 11 is preferably not smaller than 1 μm, more preferably not smaller than 5 μm, and even more preferably not smaller than 10 μm. From the viewpoint of suppressing corrosion of the copper-made base member 12, the gap 13 between the copper-made base member 12 and the titanium-made coating layer 11 is preferably not larger than 30 μm.

The busbar member 16 has high corrosion resistance due to the structure that the surface of the copper-made base member 12 is covered with the titanium-made coating layer 11, and the copper-made base member 12 does not corrode even if the plating solution 4 is attached to a surface of the busbar member 16. Therefore, maintenance of the busbar member 16 is easy, and the busbar member 16 can be used stably for a long period. In addition, electric power can be supplied even in a state in which the busbar member 16 is immersed in the plating solution 4.

As described later, the busbar member 16 is manufactured by coating titanium on the copper-made base member 12 without performing particular treatment such as surface treatment. Accordingly, an oxide film having a thickness of about 1 μm is formed on the surface of the copper-made base member 12. When the oxide film is formed on the surface of the copper-made base member 12, adhesion between the copper-made base member 12 and the titanium-made coating layer 11 is reduced, and the gap 13 can be more easily formed.

The sizes of the first busbar 10A and the second busbar 10B are not limited to particular values, and they may be appropriately modified depending on the size of the plating processing apparatus. Because the plating processing apparatus generally includes a plurality of the plating tanks 1 each having a size of about 1 m to 2 m, the lengths of the busbar members 16 constituting the first busbar 10A and the second busbar 10B are several meters to several ten meters. Furthermore, the width of the busbar member 16 is not limited and may be set to, for example, about 100 mm to 500 mm. The thickness is also not limited and may be set to about 5 mm to 15 mm. The shape of a principal surface of the busbar member 16 is not limited to a rectangular shape, and it may have an L-like shape or a U-like shape.

In the busbar member 16, the copper-made base member 12 may contain an ingredient other than copper, but it is preferably made of high-purity copper from the viewpoint of reducing the electrical resistance of the busbar member 16.

In the busbar member 16, the titanium-made coating layer 11 is not always required to be made of pure titanium, and it is just required to contain titanium as a main ingredient. The titanium-made coating layer 11 may contain an ingredient other than titanium for the purpose of, for example, improving the corrosion resistance and reducing the electrical resistance.

As the thickness of the titanium-made coating layer 11 increases, the corrosion resistance of the busbar member 16 increases, but the larger thickness causes an increase in the electrical resistance of the connection portion. For that reason, the thickness of the titanium-made coating layer 11 is preferably not smaller than 0.1 mm and not larger than 2.0 mm, more preferably not smaller than 0.3 mm and not larger than 1.5 mm, and even more preferably not smaller than 0.5 mm and not larger than 1.0 mm.

The busbar member 16 can be manufactured, for example, by shaping titanium into a cylindrical form, inserting copper into a hollow portion of the cylindrical titanium, and rolling it. Rolling conditions are appropriately changed depending on the size of the busbar member 16 such that the gap 13 between the copper-made base member 12 and the titanium-made coating layer 11 is not smaller than 1 μm. Furthermore, an end portion of the busbar member 16 is covered with titanium by welding, for example, to avoid copper from being exposed at the end portion of the busbar member 16.

In the first connection portion and the second connection portion, pressure is applied, for example, by tightening a bolt such that the gap 13 is not generated between the copper-made base member 12 and the titanium-made coating layer 11.

The plating processing apparatus according to the embodiment of the present disclosure may be of the type that the plating object 5 is horizontally conveyed and plated in the plating tank 1, or the type that the plating object 5 is vertically conveyed and plated.

Figure 3:
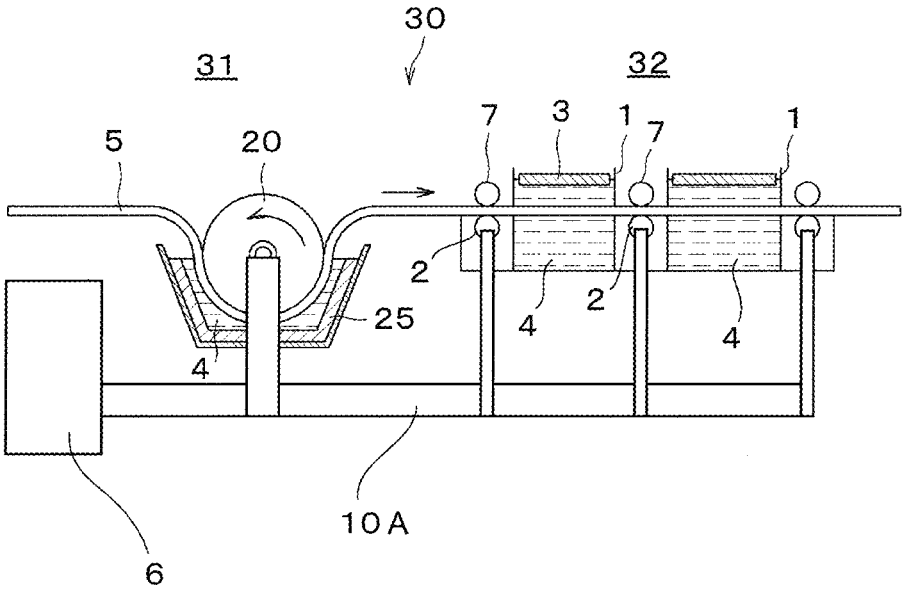
FIG. 3 schematically illustrates another example of the plating processing apparatus according to the embodiment of the present disclosure.

FIG. 3 schematically illustrates an example of structure of the plating processing apparatus 30 of the type that the plating object 5 is horizontally conveyed and plated in the plating tank 1. The plating processing apparatus 30 is constituted to convey the plating object 5 from the left side to the right side in FIG. 3, and it includes a first plating tank 31 and a second plating tank 32 disposed downstream of the first plating tank 31.

The first plating tank 31 includes a plating solution 4, a power supply roller 20 (cylindrical cathode), and an anode 25 disposed on an inner wall of a container. The power supply roller 20 is connected to a control panel 6 or a conductive member, which is connected to a control panel 6, through a first busbar 10A for supply of electric power. Though not illustrated in FIG. 3, the anode 25 is also connected to the control panel 6 or a conductive member, which is connected to the control panel 6, through a busbar for supply of electric power. The plating object 5 passes through the plating solution 4 along the power supply roller 20, whereby a plating film is formed on one surface side (lower surface side in FIG. 3) of the plating object 5.

Figure 4:
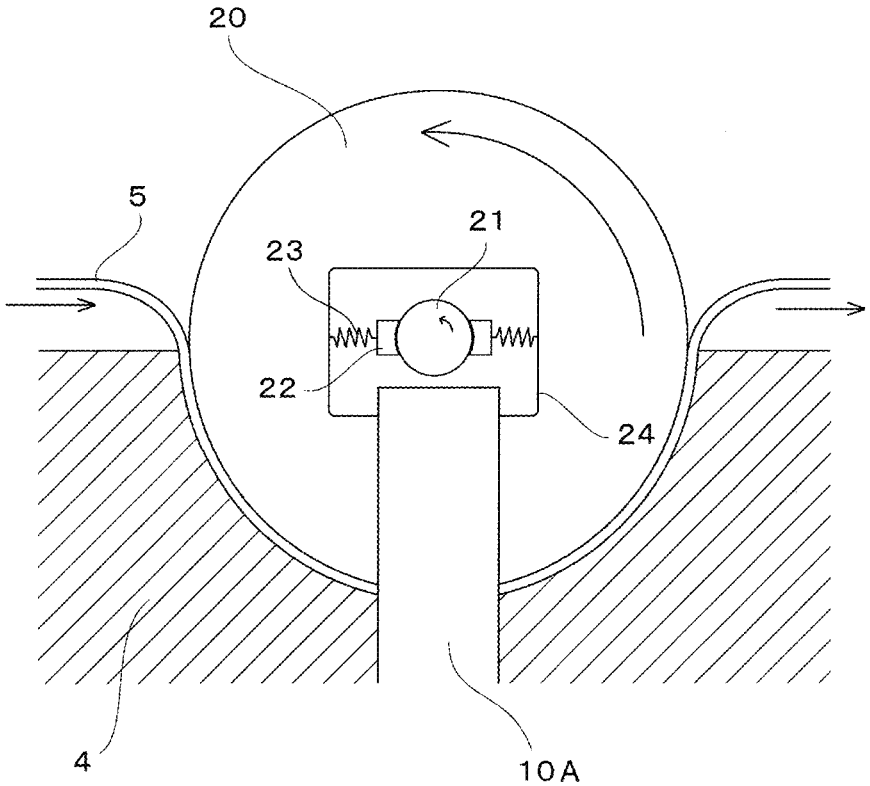
FIG. 4 schematically illustrates an example of structure of a connection portion between a power supply roller and a busbar in the plating processing apparatus illustrated in FIG. 3.

FIG. 4 schematically illustrates an example of a state in which the power supply roller 20 and the first busbar 10A are connected to each other. In the example illustrated in FIG. 4, a power supply brush 22 is biased by a biasing member 23 to be pressed against and brought into sliding contact with part of an outer peripheral surface of a rotating shaft 21 of the power supply roller 20. One end portion of the biasing member 23 is attached to an inner surface of a housing 24. The power supply roller 20, the rotating shaft 21, the power supply brush 22, the biasing member 23, and the housing 24 are each just required to be made of a conductive material. Thus, electric power can be supplied to the power supply roller 20 by connecting the first busbar 10A to the housing 24.

In the plating processing apparatus 30 illustrated in FIG. 3, the second plating tank 32 includes a plurality of plating tanks 1 in each of which a plating film is formed on the other surface side (upper surface side in FIG. 3) of the plating object 5. The plating object 5 is sequentially conveyed in a state sandwiched between a plurality of feed rollers 7 and a plurality of power supply rollers 2, those rollers being arranged adjacent to the plating tanks 1. The power supply rollers 2 are each connected to the control panel 6 or a conductive member, which is connected to the control panel 6, through the first busbar 10A for supply of electric power. The electric power can be supplied to the power supply roller 2 in a similar manner to that illustrated in FIG. 4.

In each of the plating tanks 1, an anode case 3 is disposed at a position facing the other surface side of the plating object 5 with the plating solution 4 interposed between them. Though not illustrated in FIG. 3, the anode case 3 is connected to the control panel 6 or a conductive member, which is connected to the control panel 6, through a second busbar 10B for supply of electric power. The anode case 3 contains a metal to be plated on the plating object 5. By supplying electric power to the anode case 3 and the power supply roller 2 (i.e., a power supply cathode outside the tank), a plating film is formed on the other surface side of the plating object 5.

Figure 5:
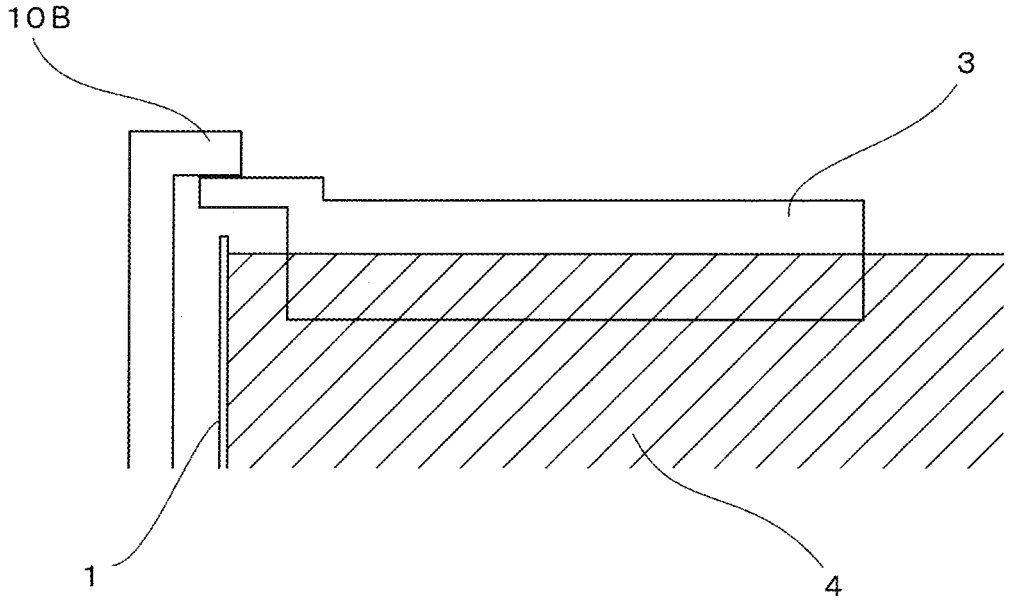
FIG. 5 schematically illustrates an example of structure of a connection portion between an anode case and a busbar in the plating processing apparatus illustrated in FIG. 3.

FIG. 5 schematically illustrates an example of a state in which the anode case 3 and the second busbar 10B are connected. In the example illustrated in FIG. 5, the anode case 3 is disposed to position at a liquid surface of the plating solution 4, and it contains a metal to be plated on the plating object 5. The anode case 3 is just required to be constituted such that the metal disposed inside the anode case 3 can be held in contact with the plating solution 4. The second busbar 10B is just required to be connected to part of the anode case 3. With the anode case 3 made of a conductive material, electric power can be supplied to the metal disposed in the anode case 3.

Figure 6:
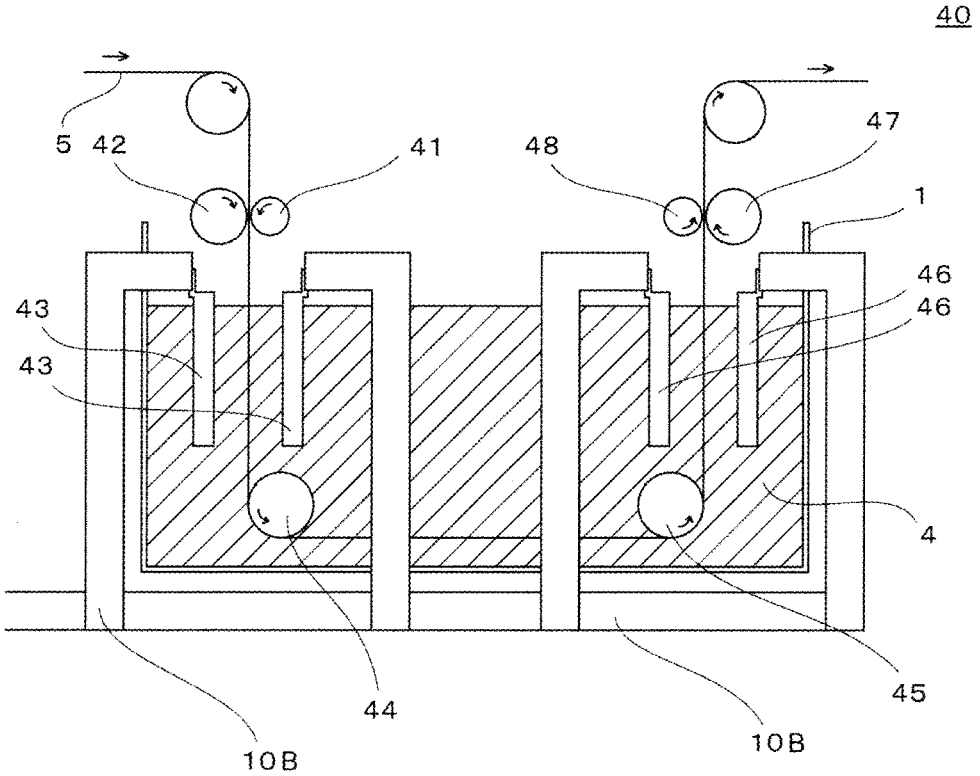
FIG. 6 schematically illustrates still another example of the plating processing apparatus according to the embodiment of the present disclosure.

FIG. 6 schematically illustrates an example of structure of the plating processing apparatus of the type in which the plating object 5 is vertically conveyed and plated in the plating tank. The plating processing apparatus illustrated in FIG. 6 includes a preliminary plating tank (not illustrated), and a lifting-type main plating tank 40 installed downstream of the preliminary plating tank.

The preliminary plating tank is to carry out preliminary plating on the one surface side of the plating object 5 in a plating solution while the plating object 5 is horizontally conveyed as in the plating processing apparatus illustrated in FIG. 1.

The main plating tank 40 includes a plating solution 4, a first retaining roller 41, a first power supply roller 42, a pair of first anode cases 43, a first feed roller 44, a second feed roller 45, a pair of second anode cases 46, a second power supply roller 47, and a second retaining roller 48.

In the main plating tank 40, the plating object 5 is sequentially conveyed in a state sandwiched between the first retaining roller 41 and the first power supply roller 42, and is withdrawn into a region between the pair of first anode cases 43 disposed in the plating solution 4. Each of the first anode cases 43 contains a metal to be plated on the plating object 5 and is constituted such that the metal disposed inside the first anode case 43 can be held in contact with the plating solution 4. By supplying electric power to a rotating shaft of the first power supply roller 42 and the pair of first anode cases 43, a plating film can be formed on each of the both surface sides of the plating object 5.

Then, the plating object 5 is sequentially fed into a region between the pair of second anode cases 46 by the first feed roller 44 and the second feed roller 45 in the plating solution 4. Furthermore, the plating object 5 is conveyed by the second retaining roller 48 and the second power supply roller 47, and is sequentially lifted up from the plating solution 4. Each of the second anode cases 46 contains a metal to be plated on the plating object 5 and is constituted such that the metal disposed inside the second anode case 46 can be held in contact with the plating solution 4. By supplying electric power to the pair of second anode cases 46 and a rotating shaft of the second power supply roller 47, a plating film can be formed on each of the both surface sides of the plating object 5. The rotating shaft of the first power supply roller 42 and the rotating shaft of the second power supply roller 47 are each connected to the control panel 6 or the conductive member, which is connected to the control panel 6, through the first busbar 10A for supply of electric power. The electric power can be supplied to the rotating shaft of the first power supply roller 42 and the rotating shaft of the second power supply roller 47 in a similar manner to that illustrated in FIG. 4. The pair of first anode cases 43 and the pair of second anode cases 46 are each connected to the control panel 6 or the conductive member, which is connected to the control panel 6, through the second busbar 10B for supply of electric power.

In the plating processing apparatus described above, it is not so often to establish electrical connection between the power supply roller and the control panel, between the anode and the control panel, and between the anode case and the control panel by using one busbar member. In many cases, the electrical connection is established by connecting a plurality of busbars members. In the present disclosure, a portion in which the busbar members are connected to each other is called the first connection portion, and a portion in which the busbar member is connected to a member other than the busbar member (such as the anode case, the power supply roller, the control panel, or the conductive member connected to the control panel) is called the second connection portion. When both end portions of one busbar member are each connected to another busbar member, the relevant busbar member includes only the first connection portion. When both end portions of one busbar are each connected to a member other than the busbar, the relevant busbar includes only the second connection portion.

In the plating processing apparatus according to the embodiment of the present disclosure, when the first busbar 10A and the second busbar 10B have the first connection portions, each of the first connection portions preferably has a structure in which the copper-made base members 12 are directly welded to each other.

Figure 7:
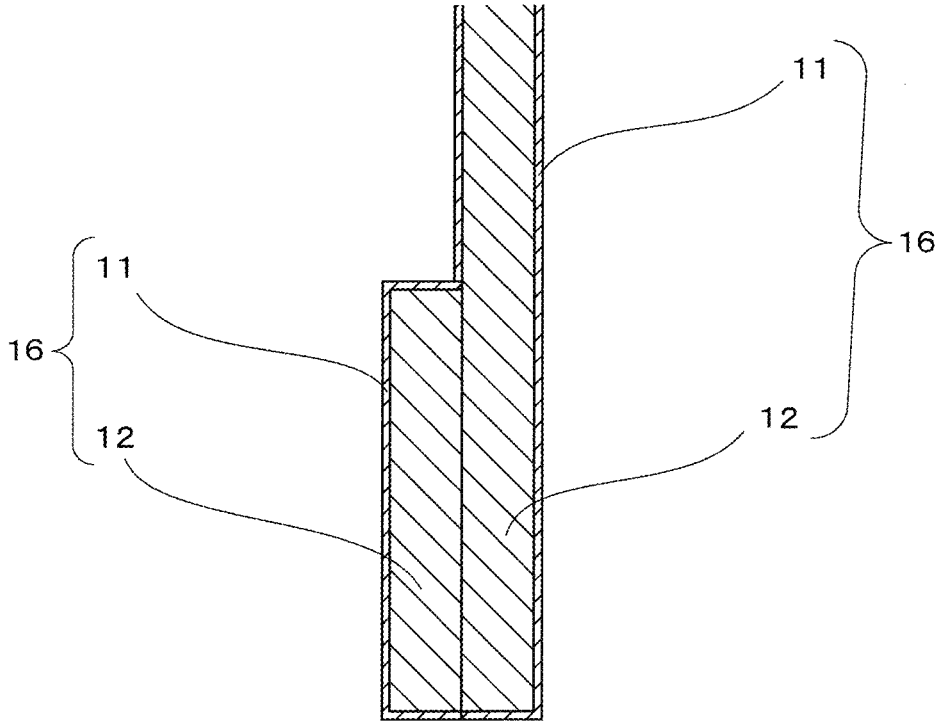
FIG. 7 is a partial enlarged view illustrating one example of structure of a first connection portion in which the busbar members are connected to each other.

FIG. 7 is a schematic sectional view referenced to explain a structure of the first connection portion in which the copper-made base members 12 are connected to each other. In FIG. 7, the copper-made base member 12 illustrated on the left side extends in a direction vertical to the drawing sheet, and the copper-made base member 12 illustrated on the right side extends upward in FIG. 7. The first connection portion can be formed by removing the coating layers 11 in portions of the busbar members 16 where they are to be contacted with each other, and by welding the copper-made base members 12 to each other in a directly-contacted state. Since the copper-made base members 12 are directly bonded to each other, it is possible to significantly reduce the electrical resistance in the first connection portion and to improve power supply efficiency. Thus, heat generation in the first connection portion during power-on time can be reduced, and the temperature therein can be kept at about 30° C. or below. In addition, an area in which the copper-made base members 12 are bonded to each other can be comparatively reduced.

The copper-made base members 12 are preferably welded to each other by electron beam welding that has a capability of deep penetration. When welding the copper-made base members 12 by the electron beam welding, special treatment such as surface treatment is not required to be carried out on the surfaces of the copper-made base members 12. In the case of welding the copper-made base members 12, the busbar members 16 cannot be separated from each other in the first connection portion. Therefore, the bonding by the welding is preferably performed in a portion where there is no necessity of separating the busbar members 16 from each other during power-off time or maintenance of the plating processing apparatus.

In another preferred example of structure of the first connection portion in which the busbar members 16 are connected to each other, the busbar members 16 are connected by bolts. When the busbar members 16 are connected by bolts, the electrical resistance in the first connection portion is increased in comparison with the case of welding the copper-made base members 12, but the busbar members 16 can easily be connected and separated. Thus, the connection using bolts is preferably performed in a portion where there is a necessity of separating the busbar members 16 from each other during power-off time or maintenance of the plating processing apparatus.

Figure 8:
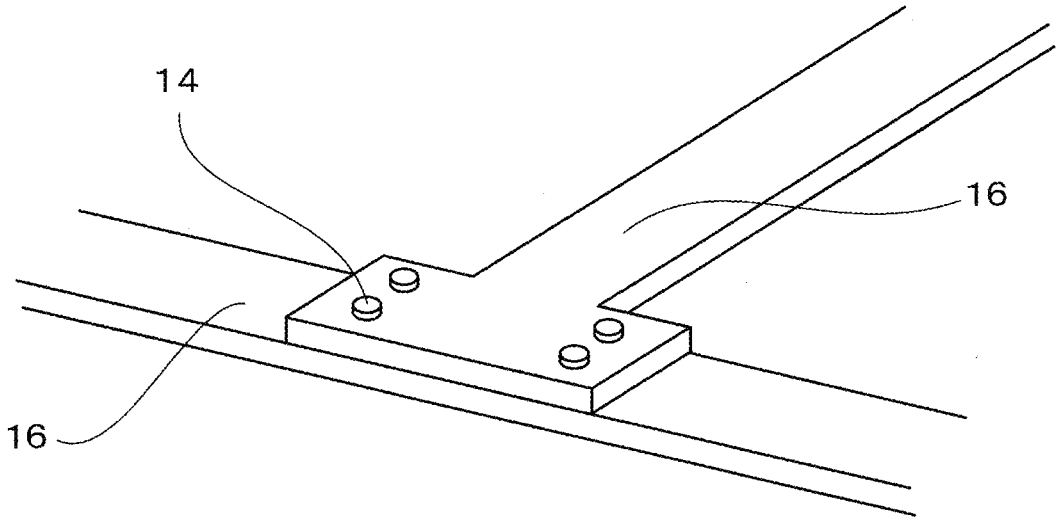
FIG. 8 is a partial enlarged view illustrating another example of structure of the first connection portion in which the busbar members are connected to each other.

FIG. 8 is a schematic perspective view referenced to explain a structure of the first connection portion in which the busbar members 16 are connected to each other by bolts 14. Because of each busbar member 16 having the surface entirely covered with titanium, when the busbar members 16 are connected to each other in an overlapped state, the electrical resistance is increased and heat is more apt to generate with supply of electric power. In the case of connecting the busbar members 16 by the bolts 14, therefore, an end portion of at least one of the busbar members 16 is preferably formed in a T-like shape as illustrated in FIG. 8, aiming to increase an area of a contact portion between the busbar members 16 and to reduce the electrical resistance in the connection portion. As a result, heat generation in the first connection portion during power-on time can be reduced, and the temperature therein can be kept at about 30° C. or below.

The second connection portion in which the busbar member 16 is connected to the member other than the busbar member 16 may also have, as in the first connection portion, a structure of connecting both the members by the bolts 14. Such a structure enables the busbar member 16 and the member other than the busbar member 16 to be easily connected and separated. Also in the second connection portion, either one of an end portion of the busbar member 16 and the member other than the busbar member 16 or both of an end portion of the busbar member 16 and the member other than the busbar member 16 are preferably formed in a T-like shape for the purpose of reducing the electrical resistance.

When the first connection portion or the second connection portion has the T-like shape and the connection portion has a large area, the contact between the busbar members 16 or between the busbar member 16 and the member other than the busbar member 16 tends to be unstable. Accordingly, the connection strength of the connection portion is preferably increased by using the plurality of bolts 14.

As the contact area between the busbar members 16 or between the busbar member 16 and the member other than the busbar member 16 increases, the number of bolts used in the first connection portion or the second connection portion is preferably increased to make the contact more stable. For example, the number of bolts 14 is preferably not smaller than $2/m^2$ on the basis of the contact area between the busbar members 16 or between the busbar member 16 and the member other than the busbar member 16. Furthermore, the number of bolts in the first connection portion or the second connection portion is preferably one or more per current of 125 A flowing in the first connection portion or the second connection portion.

A material of the bolt 14 is not limited to particular one, but it is preferably superior in corrosion resistance and is durable against large tightening torque. For example, a stainless hexagonal head bolt can be preferably used. When the bolt 14 is the stainless bolt, the connection strength of the first connection portion or the second connection portion can be further increased in a state connected by the bolts 14.

Moreover, the size of the bolt 14 is not limited to particular one. In consideration of the tightening torque, etc., a bolt such as called M12 in conformity with JIS B 1180: 2014, for example, can be preferably used. When a sufficient installation space is secured, a bolt having a larger diameter may be used.

Figure 9:
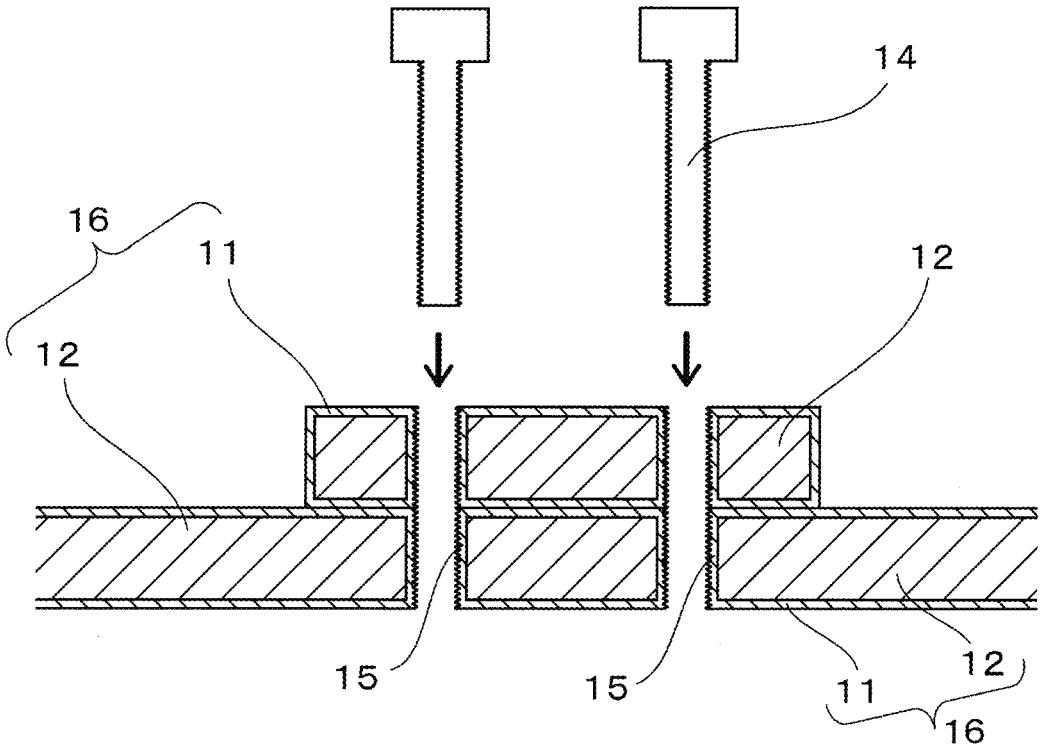
FIG. 9 is a partial sectional view of the first connection portion illustrated in FIG. 8.

FIG. 9 is a partial section view of the connection portion between the busbar members 16 illustrated in FIG. 8. As illustrated in FIG. 9, when the bolts 14 are used for connection in the first connection portion or the second connection portion of the busbar member 16, the busbar 10 is preferably constituted such that an inner peripheral surface 15 of a screw hole into which each bolt 14 is screwed is also covered with the titanium-made coating layer 11. The presence of the titanium-made coating layer 11 can increase the corrosion resistance of the busbar member(s) 16 in the first connection portion or the second connection portion.

REFERENCE SIGNS LIST

1 plating tank
2 power supply roller
3 anode case
4 plating solution
5 plating object
6 control panel
7 feed roller
10A first busbar
10B second busbar
11 titanium-made coating layer
12 copper-made base member
13 gap
14 bolt
15 inner peripheral surface of screw hole

16 busbar member
20 power supply roller
21 rotating shaft
22 power supply brush
23 biasing member
24 housing
25 anode
30 plating processing apparatus
31 first plating tank
32 second plating tank
40 main plating tank
41 first retaining roller
42 first power supply roller
43 first anode case
44 first feed roller
45 second feed roller
46 second anode case
47 second power supply roller
48 second retaining roller

The invention claimed is:

1. A plating processing apparatus in which a plating object is immersed in a plating solution to form a plating layer on a surface of the plating object, the plating processing apparatus comprising:

a plating tank containing the plating solution;

a power supply roller rotated while supplying electric power to the plating object, and conveying the plating object to be immersed into the plating solution contained in the plating tank and then moved to outside of the plating solution;

an anode case disposed inside the plating tank and held in electrical contact with the plating solution contained in the plating tank;

a control panel controlling electric power supplied to the power supply roller and the anode case;

a first busbar electrically connecting the power supply roller and the control panel; and a second busbar electrically connecting the anode case and the control panel, wherein the first busbar and the second busbar are each constituted by a plurality of busbar members each of which includes a copper-made base member and a titanium-made coating layer covering a surface of the base member, each busbar member of the respective plurality of busbar members constituting the first busbar and the second busbar includes (i) a first connection portion connected to another busbar member of the respective plurality of busbar members, and (ii) a second connection portion connected to the power supply roller, the anode case, or the control panel, and a portion of each busbar member other than the first connection portion and the second connection portion includes a gap between the base member and the coating layer.

2. The plating processing apparatus according to claim 1, wherein the gap is not smaller than 1 μm.

3. The plating processing apparatus according to claim 1, wherein the base member of each busbar member is directly welded to a base member of another busbar member in the first connection portion.

4. The plating processing apparatus according to claim 1, wherein an end portion of one of the base members of each busbar member and the another busbar member has a T-like shape in the first connection portion, and the first connection portion includes a plurality of screw holes with a plurality of bolts screwed into the plurality of screw holes for connection.

5. The plating processing apparatus according to claim 4, wherein the plurality of bolts comprises one or more bolts per 125 A of current flowing in the first connection portion.

6. The plating processing apparatus according to claim 4, wherein the number of the bolts is one or more per current of 125 A flowing in the first connection portion or the second connection portion.

7. The plating processing apparatus according to claim 4, wherein the bolts are made of stainless steel.

8. The plating processing apparatus according to claim 4, wherein inner peripheral surfaces of the screw holes which are formed in each busbar member and the another busbar member and into which the bolts are screwed are covered with titanium-made coating layers.

9. The plating processing apparatus according to claim 8, wherein the plurality of bolts comprises one or more bolts per 125 A of current flowing in the second connection portion.

* * * * *